US006237388B1

(12) United States Patent
McClung et al.

(10) Patent No.: US 6,237,388 B1
(45) Date of Patent: May 29, 2001

(54) TRANSFER APPARATUS AND METHOD FOR TRANSFERRING CONTAINER BODIES IN A PRESS

(75) Inventors: James A. McClung, North Canton, OH (US); Manuel P. Rubalcava, San Jose, CA (US)

(73) Assignee: Can Industry Products, Inc.

( * ) Notice: Subject to any disclaimer, the term of this patent is extended or adjusted under 35 U.S.C. 154(b) by 0 days.

(21) Appl. No.: 09/521,040

(22) Filed: Mar. 8, 2000

(51) Int. Cl.[7] ..... B21D 24/16
(52) U.S. Cl. ..... 72/361; 248/363
(58) Field of Search ..... 72/361, 405.08, 72/405.1; 248/309.3, 362, 363

(56) References Cited

U.S. PATENT DOCUMENTS

| | | | |
|---|---|---|---|
| 3,902,347 | 9/1975 | Ridgway et al. | 72/336 |
| 5,483,876 | 1/1996 | Davis et al. | 100/207 |
| 5,626,048 | 5/1997 | McClung | 72/336 |
| 5,823,041 | 10/1998 | McClung | 72/349 |

*Primary Examiner*—Lowell A. Larson
(74) *Attorney, Agent, or Firm*—Sand & Sebolt

(57) ABSTRACT

A transfer pad for assisting in transferring a container body between work stations in a press has a flat planar guide surface extending between a pair of spaced guide rails for receiving the container body therebetween. A plurality of air holes are formed in the guide surface and extend along each of the guide rails. A vacuum is applied to peripheral edges of the container body through the air holes to maintain the container body in a secure position on the pad until being transferred to the succeeding work station. The ends of the guide rails are tapered to assist in guiding the container body between the rails.

19 Claims, 5 Drawing Sheets

FIG-2
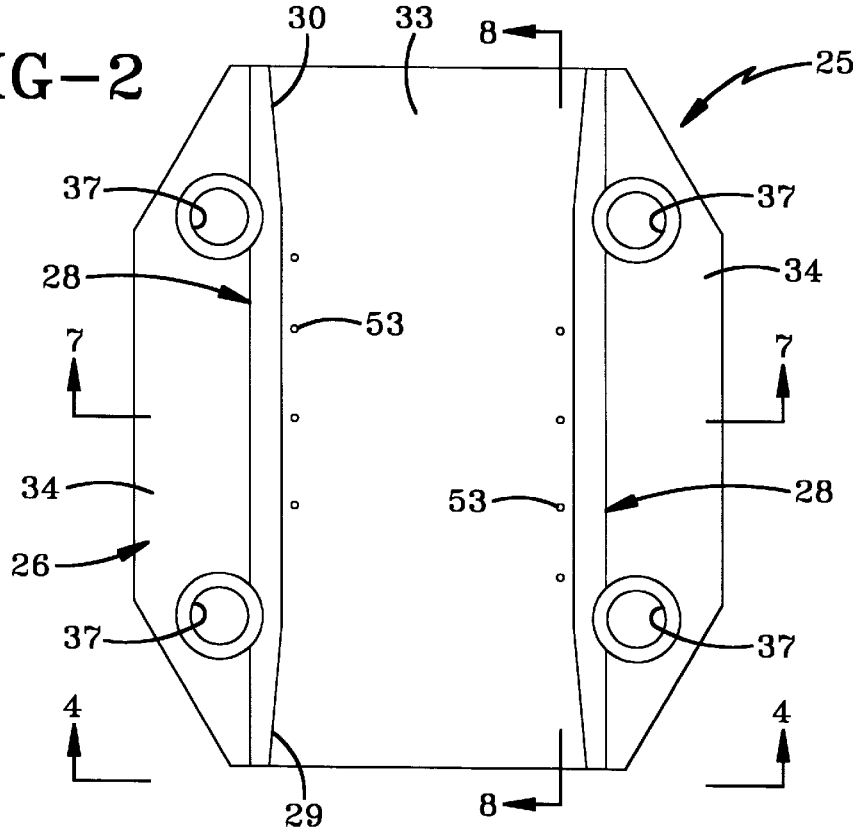
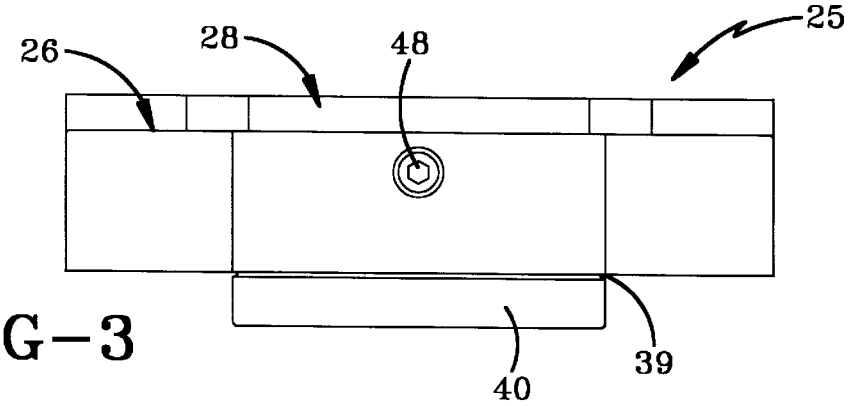
FIG-3
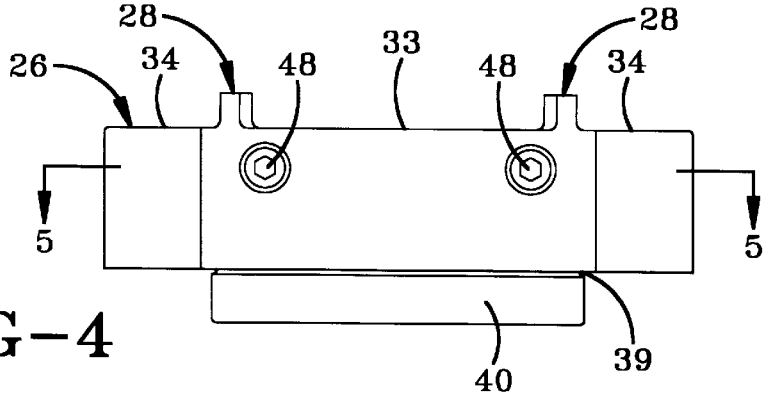
FIG-4

TRANSFER APPARATUS AND METHOD FOR TRANSFERRING CONTAINER BODIES IN A PRESS

BACKGROUND OF THE INVENTION

1. Technical Field

The invention relates to container body forming presses for stamping metal can bodies from a strip of sheet metal in a succession of work stations in the press. More particularly, the invention relates to a transfer apparatus mounted in a fixed position on the base of the press between work stations for receiving and maintaining container bodies in a fixed position between work stations as the press is performing an operation on the adjacent can bodies at the work stations.

2. Background Information

It is well known in the container forming art to form two piece containers, that is, containers in which the walls and bottom of the container are a one piece member and the top end closure is a separate piece by stamping a plurality of blanks in a single or double action press from a strip of sheet metal and then subsequently drawing and redrawing the desired can body configuration into the blank in a series of work stations in the press.

These presses use multiple stage dies, that is, a single downward stroke of the press may simultaneously blank a plurality of disks from the sheet metal while at another station will draw the previously cut blank into a first stage can body while at still another work station in of the press the drawn can body will be redrawn into a final configuration or provide for a stepped shoulder or profile bottom thereto, with another station then trimming the annular outer flange of the can body to form the final container configuration. In these multiple station presses, a blank or dead space is generally provided between the work stations so that as the can body advances through the press it will rest in a dead space during each successive stroke while the press is performing a forming operation on the adjacent can bodies. Various mechanisms have been devised for sequentially moving the can bodies through the various stages of forming, that is, between the blank station to the redraw station to the shoulder and profile forming station, and then to the trimming station.

The prior art apparatus provided at the dead spaces between work stations usually will maintain the partially formed can body in position by applying a vacuum to the bottom of the body as it rests upon a transfer pad mounted in the dead space. This vacuum retention has proved satisfactory for prior art container bodies, especially those having a round bottom since the orientation of the body at the dead space always results in a similar shape bottom for gripping by the vacuum. However, more recently, various configured containers are being formed from the sheet metal other than a round container, one such example being a generally rectangular or elongated oval shaped container used for the storage of canned meat products such as sold under the trademark SPAM® and TREET®. The secure retention of these elongated can bodies on the transfer pads becomes more difficult due to the formation of a raised rib generally along only part of the can bottom which raises the majority of the can bottom wall off of the surface of the transfer pad making it extremely difficult for the suction of the vacuum to adequately hold the can against the pad surface due to the constant incoming of air through openings formed by the non continuous peripheral ribs or projections on the container bottom. The proper retention of the container bodies on the transfer pads becomes increasingly important and more difficult to satisfactorily achieve with the non circular shaped container bodies due to the ever increasing speed of the press and resulting transfer of the container bodies between the various work stations.

Therefore, the need exists for an improved transfer pad located at the transfer or dead areas of a multiple station press for securely gripping and positioning non circular container bodies thereon.

SUMMARY OF THE INVENTION

Objectives of the invention include providing an improved apparatus and method for properly positioning and retaining non circular container bodies in the dead spaces of a multiple station press between adjacent work stations without materially modifying the operation of the press or the previously used transfer pad configuration and mounting arrangement.

Another objective of the invention includes providing such a method and apparatus in which a transfer pad includes a generally flat planar elongated surface located between a pair of guide rails which rails have converging tapers to facilitate the entrance of the container bodies into the transfer pad, and in which a plurality of air holes extend along each of the guide rails closely adjacent thereto for aligning with the raised edges or ribs formed on the contoured bottom of the container body for firmly holding the container body to the transfer pad by a vacuum impressed thereon.

A still further objective of the invention is to provide such a method and apparatus which enables the improved transfer pad to be mounted by convenient mounting bolts at the same location and area as existing draw pad thereby requiring very little modifications to the existing press.

Another objective of the invention is to provide such an apparatus which achieves the stated objectives in a relatively simple, inexpensive, yet efficient manner.

These objectives and advantages are obtained by the improved apparatus of the present invention, the general nature of which may be stated as including an apparatus for assisting in transferring a container body between stations in a press which forms said body from sheet metal, said apparatus including a pad having an upper surface; means for mounting said pad in a fixed position on a base of said press; a pair of substantially parallel guide rails extending outwardly from the upper surface forming a guide surface therebetween; a vacuum manifold formed within the pad adapted to be connected to a vacuum source; a plurality of air holes formed in the pad and extending between the manifold and guide surface and located closely adjacent the rails for applying a vacuum against a bottom edge of the container body to maintain said body in position on the pad as said body is being transferred between stations in the press.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

FIG. 2 is an enlarged top plan view of the transfer pad removed from the press of FIG. 1;

FIG. 3 is a side elevational view of FIG. 2;

FIG. 4 is an end elevational view looking in the direction of arrows 4—4, FIG. 2;

Similar numerals refer to similar parts throughout the drawings.

DESCRIPTION OF THE PREFERRED EMBODIMENT

Figure 1:
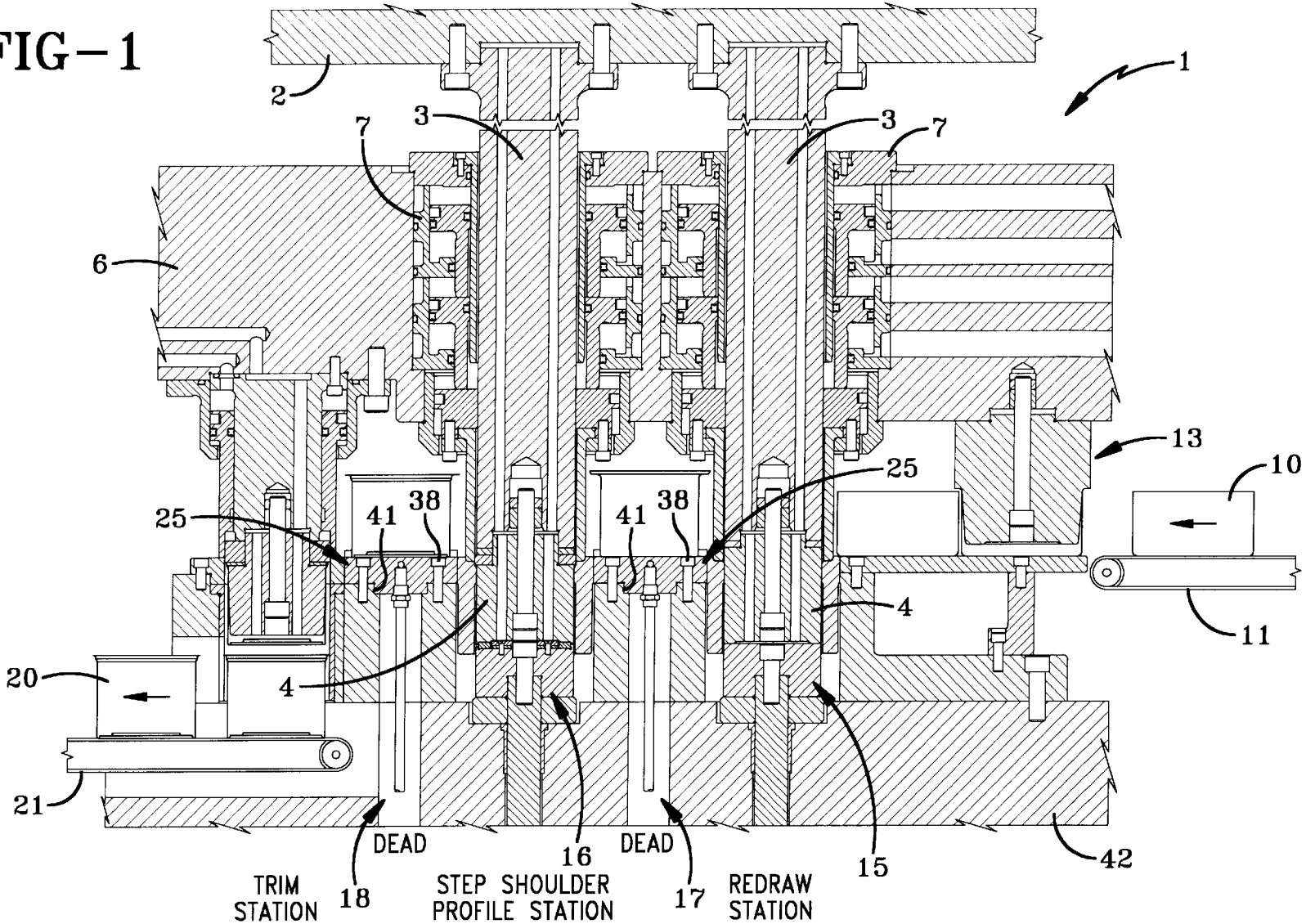
FIG. 1 is a diagrammatic sectional view of a one type of multiple station press in which the improved transfer pad is utilized.
Figure 5:
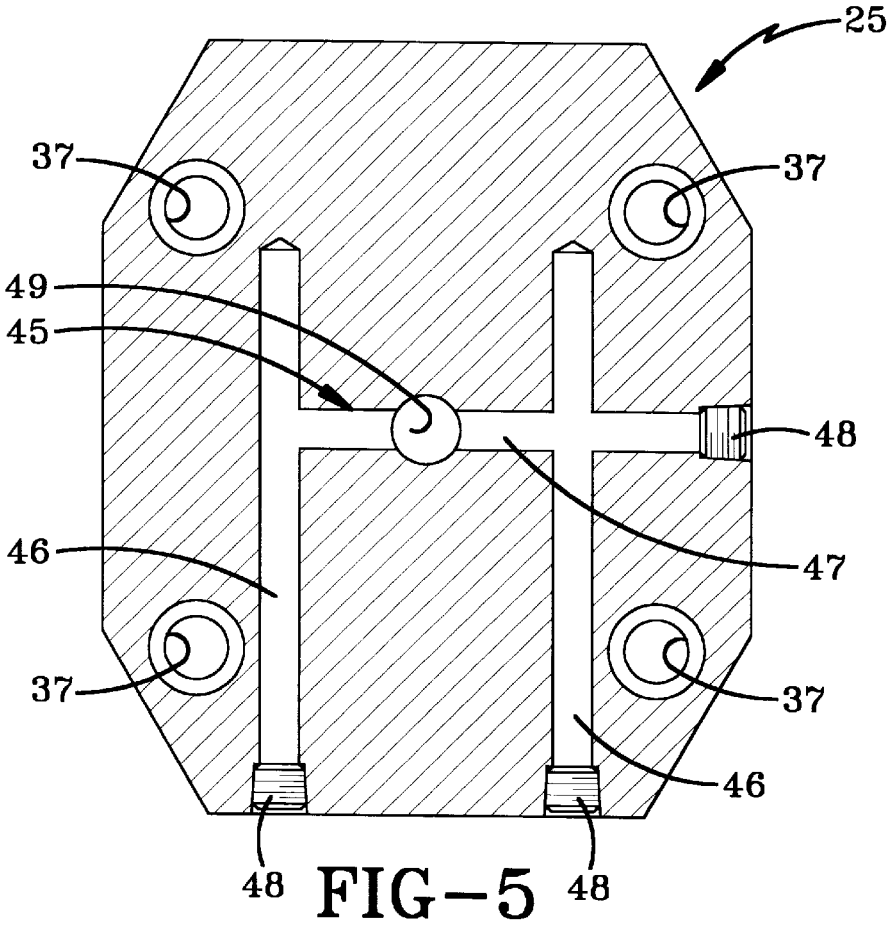
FIG. 5 is a sectional view taken along line 5—5, FIG. 4.
Figure 6:
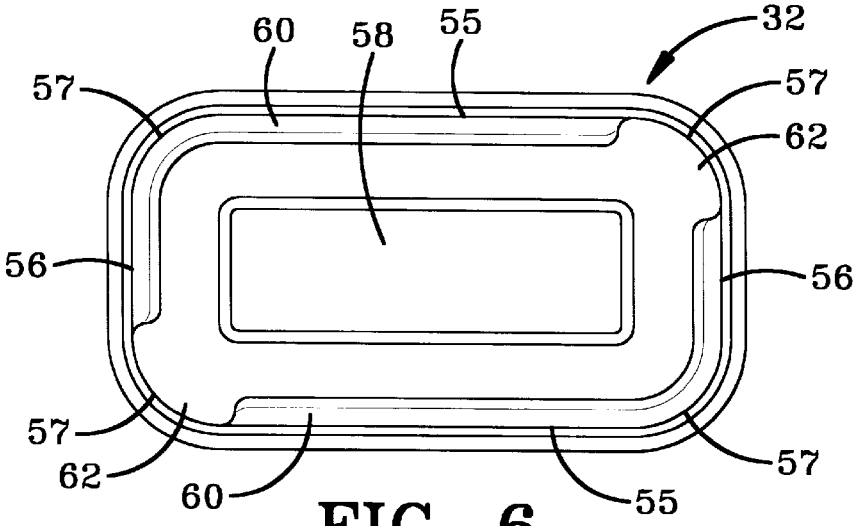
FIG-6 PRIOR ART
FIG. 6 is a bottom plan view of the bottom surface of a container body of the type which will be used with the transfer pad of the present invention.
Figure 7:
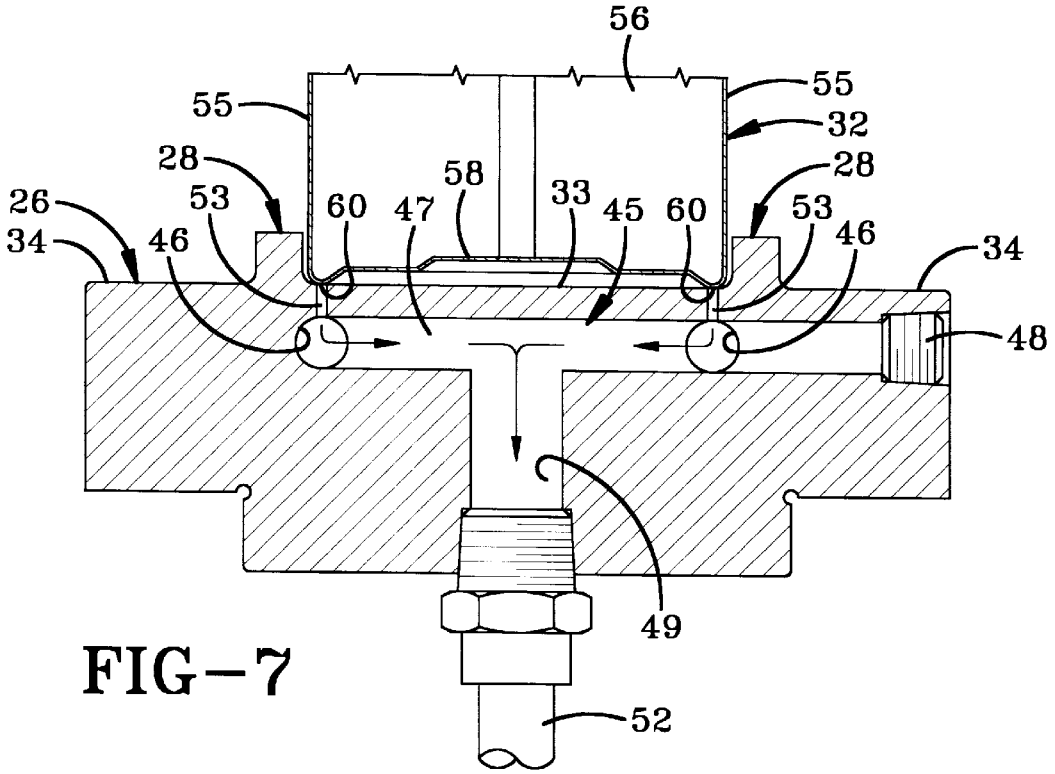
FIG. 7 is an enlarged sectional view taken on line 7—7, FIG. 2 with the container body of FIG. 6 retained thereon.
Figure 8:
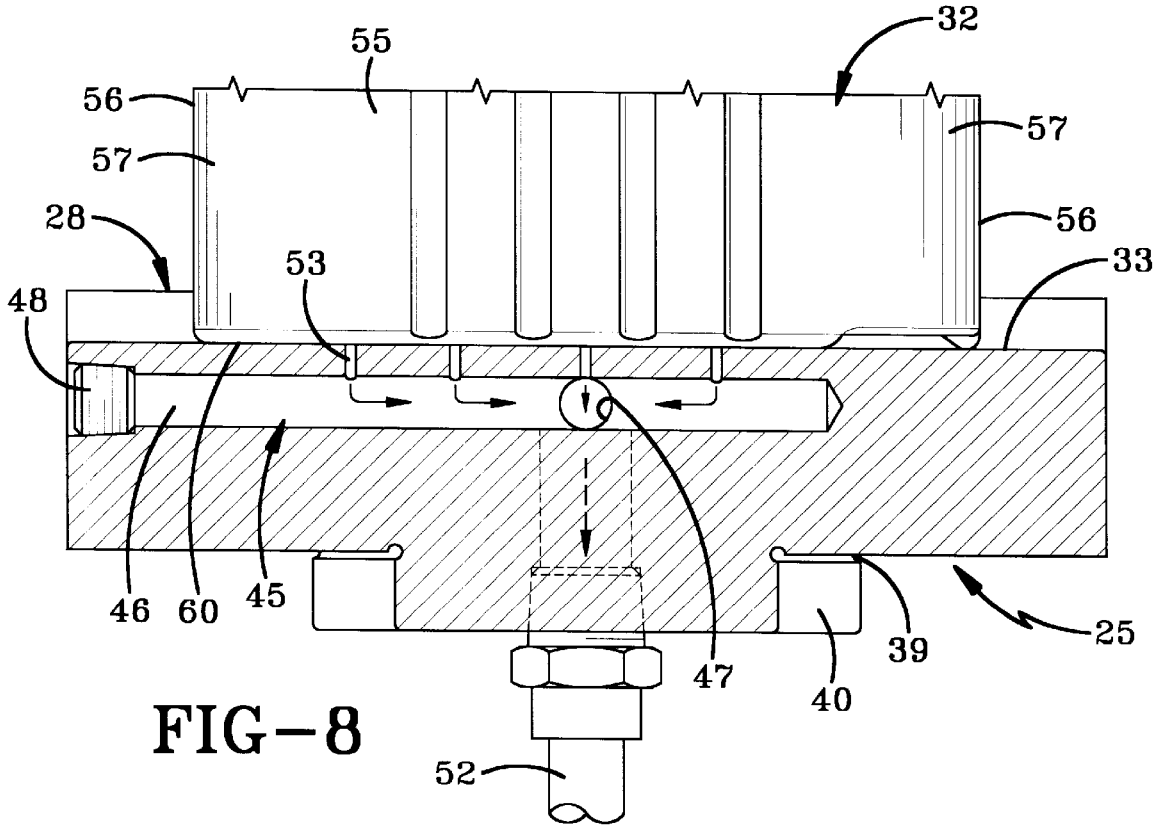
FIG. 8 is an enlarged sectional view taken on line 8—8, FIG. 2 with the container body of FIG. 6 retained thereon.
Figure 9:
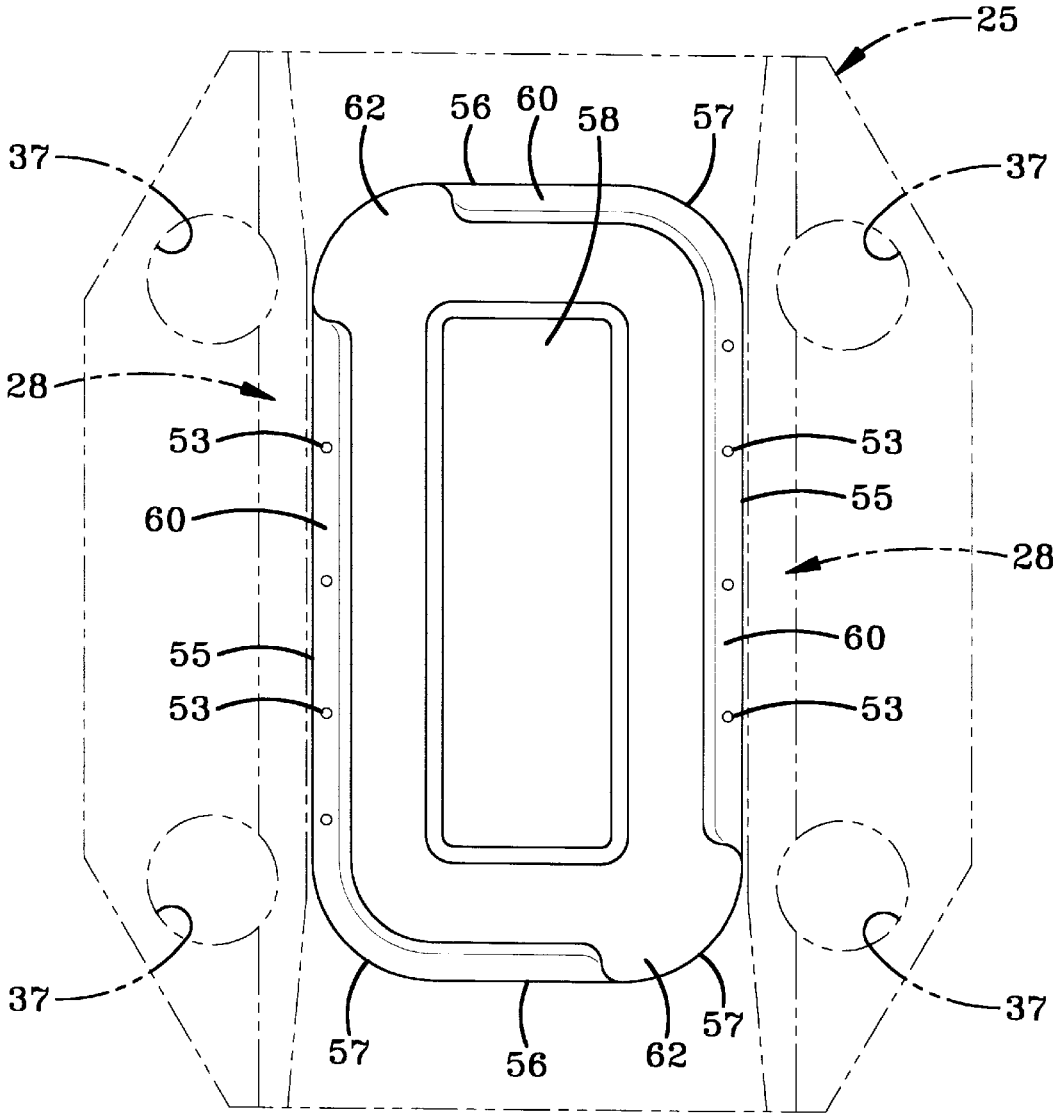
FIG. 9 is an enlarged bottom plan view of the container bottom similar to FIG. 6 showing the transfer pad in phantom lines.

A usual press of the type in which the improved transfer pad or apparatus of the present invention is utilized and the method carried out, is shown in FIG. 1 and is indicated generally at 1. Press 1 is of a usual construction and preferably will be a double acting press having an inner ram connected to a punch holder 2 to which is mounted a plurality of inner punch risers 3, two of which are shown in FIG. 1. Risers 3 will move draw horns 4 in a reciprocal vertical direction upon movement of punch holder 2 by the inner riser. An outer ram will move other press components through an outer ram housing 6 in combination with a plurality of stacked cylinders 7 which surround risers 3. Some examples of press 1 are shown in U.S. Pat. Nos. 5,626,084 and 5,823,041, the contents of which are incorporated herein by reference. Thus, press 1 is not described in any further detail and the press depicted in FIG. 1 is for illustrative purposes only.

Press 1 may include a blanking station (not shown) wherein the starting metal sheet is stamped into a blank and then moved through the press to an initial forming station. Press 1 however is shown as being of the type in which a partially formed container or can blank 10 has been formed in a separate press and is moved by a conveyor 11 into a first forming station indicated generally at 13. Press 1 further includes a redraw station indicated generally at 15, and a step shoulder profile station indicated at 16, having a dead space 17 therebetween, and having another dead space 18 at the output side of station 16. Areas 17 and 18 are referred to as "dead stations" or "dead spaces" since there is no work being done on the can blank or body at that location. Various types of transfer mechanisms well known in the art, removes a partially or finally formed container body between the various work stations 15 and 16 through dead areas 17 and 18, and thus are not shown or described in detail. The final formed container body 20 is shown being removed from the press by a conveyor 21.

The transfer pad of the present invention is indicated generally at 25, two of which are shown in FIG. 1 mounted in press 1 at dead spaces 17 and 18, with the details thereof being shown in FIGS. 2–5 and 7–9. Transfer pad 25 preferably is formed of a single block of metal and has a top generally planar surface 26 with a pair of similar guide rails 28 extending upwardly therefrom in a spaced parallel relationship to each other. Guide rails 28 are generally elongated narrow-shaped members having tapered front and rear inner surfaces 29 and 30 to facilitate the entrance and exiting of a container body 32 onto and from pad 25. Rails 28 define a generally flat planar rectangularly shaped guide surface 33 therebetween, which preferably lies on the same plane with two outer surfaces 34, which together with surface 33 form top planar surface 26. Guide surface 33, in the preferred embodiment, has a length approximately two and one-half times greater than the width.

A pair of holes 37 is formed in each of the outer surfaces 34 for receiving attachment bolts 38 therethrough as shown in FIG. 1. The bottom of pad 25 is formed with an annular stepped shoulders 39 (FIG. 7) which forms an annular block 40 which is seated in a complementary shaped cutout 41 (FIG. 1) formed in a portion of press base 42, which in combination with bolts 38 firmly mount transfer pad 25 thereon.

A vacuum manifold indicated generally at 45, is formed in transfer pad 25 and in the preferred embodiment consists of a pair of cylindrical passages 46 and a connecting passageway 47 (FIG. 5) which are drilled into pad 25 and will have plugs 48 secured in the open ends thereof to seal the passageway from the outside air. A main vacuum port 49 communicates with connecting passageway 47 and is connected to a source of vacuum by a vacuum line 52 for impressing a vacuum on manifold 45. In accordance with another feature of the invention, a series of small holes 53 are formed in guide surface 33 and communicate with passages 46 (FIGS. 7 and 8) providing fluid communication therebetween. Holes 53, four of which communicate with each passageway 46, extend in a series closely adjacent to each of the guide rails 28 (FIG. 2).

Can body 32 is shown in FIGS. 6–9 in combination with pad 25. Body 32 has a generally rectangular configuration having spaced parallel sidewalls 55 and spaced parallel end walls 56 joined by rounded corners 57, all of which are formed integrally with a profiled bottom wall 58. Bottom wall 58 is formed with a pair of spaced peripheral L-shaped projections or ribs 60 which extend throughout the majority of the bottom surface adjacent sidewalls 55 and partially along the bottom surface adjacent end walls 56. Gaps 62 are formed between the generally L-shaped projections which contribute to the problems of securing container body 32 by use of prior art vacuum holes which were located in the center of the transfer pad. However, as shown particularly in FIGS. 7, 8 and 9, air holes 53 align with these portions of bottom wall projections 60 which extend along sidewalls 55 and supply a sufficient vacuum force or suction thereto to securely retain body 32 in proper position on pad 25 between rails 28. Thus, the holding vacuum is unaffected by gaps 62 or by any other irregularities or profiles formed in bottom wall 58.

In the preferred embodiment, rails 28 will extend above top surface 26 a distance of approximately 0.25 inches and air holes 53 will have a diameter of approximately 0.05 inches. Although body 32 is shown as being a generally rectangular-shaped container or can, other non circular container bodies could be provided which have one or more straight projections extending outwardly from the bottom surface which could be aligned with air holes 53 without affecting the concept of the invention.

Thus, the improved transfer pad and method of use is an extremely simple inexpensive and effective apparatus and method for achieving the objectives, that is, the correct holding and positioning of the container body in the transfer areas or dead spaces of a forming press, which apparatus can be produced relatively inexpensively and utilized in the existing mounting locations of the press without modifying the press or the manner of attachment of the transfer pad thereto. It is readily seen that the size and spacing of rails 28 and location of air holes 53 can vary to match a particular can body configuration and in particular portions of the bottom surface which extend beyond the bottom surface of the container body formed in a particular forming press.

Accordingly, the improved transfer apparatus and method for transferring can bodies in a press is simplified, provides an effective, safe, inexpensive, and efficient device and method which achieves all the enumerated objectives, provides for eliminating difficulties encountered with prior devices and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved transfer apparatus and method for transferring can bodies in a press is construed and used, the characteristics of the construction, and the advantageous, new and useful results obtained; the new and useful structures, devices, elements, arrangements, parts and combinations and method steps, are set forth in the appended claims.

What is claimed is:

1. Apparatus for assisting in transferring a container body between stations in a press which forms said body from sheet metal, said apparatus including a pad having an upper surface; means for mounting said pad in a fixed position on a base of said press; a pair of substantially parallel guide rails extending outwardly from the upper surface forming a guide surface therebetween; a vacuum manifold formed within the pad adapted to be connected to a vacuum source; a plurality of air holes formed in the pad and extending between the manifold and guide surface and located closely adjacent the rails for applying a vacuum against a bottom projection extending from the container body to maintain said body in position on the pad as said body is being transferred between work stations in the press.

2. The apparatus defined in claim 1 in which the mounting means includes a plurality of holes formed in the pad and a plurality of bolts extending through said holes for mounting the pad on the press base.

3. The apparatus defined in claim 2 in which the mounting holes are formed outwardly of both of the spaced rails.

4. The apparatus defined in claim 1 in which the rails have inwardly tapered entrance ends for guiding the container body onto the guide surface between said rails.

5. The apparatus defined in claim 1 in which the pad has a stepped lower surface forming an annular shaped projection for mounting said pad on the press base.

6. The apparatus defined in claim 1 in which the guide surface is a substantially smooth flat planar surface.

7. The apparatus defined in claim 1 in which the air holes are formed adjacent each of the rails and have a diameter of approximately 0.05 inches.

8. The apparatus defined in claim 1 in which the guide rails have a height of approximately 0.25 inches.

9. The apparatus defined in claim 1 in which the guide surface is substantially rectangular having a length approximately two and one-half times greater than the width.

10. A method of transferring a substantially rectangular shaped container body having a non uniform bottom surface between work stations in a press including the steps of:

providing a fixed transfer pad having a pair of spaced guide rails forming an intervening guide surface and a plurality of air holes formed in the guide surface adjacent the rails;

transferring the container body forming a first work station toward the transfer pad;

guiding the container body onto the transfer pad between the spaced rails on said pad;

applying a hold down vacuum through the air holes to spaced peripheral edges of the bottom surface of the container body;

relieving the hold down vacuum from the air holes; and transferring the container body from the transfer pad to a second work station.

11. The method defined in claim 10 wherein the step of applying a hold down vacuum includes applying the vacuum through a series of spaced holes extending along each of the guide rails.

12. The method defined in claim 11 including forming the air holes with a diameter of approximately 0.05 inches.

13. The method defined in claim 11 including the step of forming the transfer pad as a single block of metal formed with a plurality of holes for receiving fasteners therethrough.

14. The method defined in claim 11 including the step of forming the guide surface as a smooth flat planar surface.

15. In combination, a non circular container body having an upstanding sidewall and a bottom wall, said bottom wall having at least one peripheral projection extending beyond the bottom wall, and an apparatus for assisting the transfer of the container body between stations in a press which forms said container body from sheet metal, said apparatus including a pad having an upper surface; means for mounting said pad in a fixed position on a base of said press; a pair of substantially parallel guide rails extending outwardly from the upper surface of the pad forming a guide surface therebetween; a vacuum manifold formed within the pad adapted to be connected to a vacuum source; a plurality of air holes formed in the pad and extending between the manifold and the guide surface and located closely adjacent at least one of the rails for applying a vacuum against the peripheral projection to maintain said container body in position on the pad as said body is being transferred between stations in the press.

16. The combination defined in claim 15 in which the rails have inwardly tapered entrance ends for guiding the container body on the guide surface between said rails.

17. The combination defined in claim 15 in which the container body is generally rectangular having spaced sidewalls and spaced end walls and a generally rectangular bottom wall; and in which two of the peripheral projections extend along the bottom wall at the junctions of the bottom wall and spaced sidewalls.

18. The combination defined in claim 17 in which two additional peripheral projections extend partially along portions of the two spaced end walls.

19. The combination defined in claim 17 in which the air holes are a series of spaced holes extending along and adjacent to each of the rails and in alignment with the peripheral projections.

* * * * *